US006347149B1

(12) United States Patent
Bachmann et al.

(10) Patent No.: US 6,347,149 B1
(45) Date of Patent: Feb. 12, 2002

(54) DRIVER FOR A FLAT ACOUSTIC PANEL

(75) Inventors: Wolfgang Bachmann, Grevenbroich; Gerhard Krump, Schwarzach; Hans-Jürgen Regl, Regensburg, all of (DE)

(73) Assignee: Harman Audio Electronic Systems GmbH, Strauberg (DE)

( * ) Notice: Subject to any disclaimer, the term of this patent is extended or adjusted under 35 U.S.C. 154(b) by 0 days.

(21) Appl. No.: 09/700,300

(22) PCT Filed: May 14, 1999

(86) PCT No.: PCT/EP99/03305

§ 371 Date: Jan. 4, 2001

§ 102(e) Date: Jan. 4, 2001

(87) PCT Pub. No.: WO99/60820

PCT Pub. Date: Nov. 25, 1999

(30) Foreign Application Priority Data

May 15, 1998 (DE) ..... 198 21 860

(51) Int. Cl.[7] ..... H04R 1/00

(52) U.S. Cl. ..... 381/396; 381/412; 381/417; 381/431

(58) Field of Search ..... 381/152, 396, 381/412, 414, 417, 420, 423, 424, 425, 431, FOR 160, FOR 161, FOR 162, FOR 163

(56) References Cited

U.S. PATENT DOCUMENTS 3,651,283 A * 3/1972 Doschek ..... 381/417
3,801,943 A 4/1974 Bertagnt
5,701,359 A 12/1997 Guenther et al.
6,160,898 A 12/2000 Bachmann et al. ..... 381/425
6,275,598 B1 * 8/2001 Bachmann et al. ..... 381/425

FOREIGN PATENT DOCUMENTS

| | | |
|---|---|---|
| DE | A-197 57 097 | 12/1997 |
| DE | 197 57 098 | 12/1997 |
| DE | 197 57 099 | 12/1997 |
| EP | 0 924 957 | 6/1999 |
| EP | 0 924 959 | 6/1999 |
| WO | WO 97/09859 | 3/1997 |
| WO | WO 97/09861 | 3/1997 |
| WO | WO 98/34320 | 8/1998 |

* cited by examiner

*Primary Examiner*—Huyen Le
(74) *Attorney, Agent, or Firm*—Foley, Hoag & Eliot LLP

(57) ABSTRACT

The invention concerns the embodiment of drivers for panel loudspeakers. Panel loudspeakers working according to the principle of bending waves are already known in prior art. Said loudspeakers generally consist of an acoustic panel (11) and at least one driver (12). As a general rule, the driver (12) is arranged on an auxiliary frame at a distance from the acoustic panel (11). Said embodiment makes it possible to use conventional drivers (12) that can also be utilized in cone loudspeakers. A series of problem arise when the drivers (12) are to be integrated on or into the acoustic panel (11) itself. Said embodiment requires inter alia that the different components of the driver (12) be directly mounted on the acoustic panel (12). Hence, the invention aims at providing a driver for panel loudspeakers that can be connected with little complications to the acoustic panel (11) as a pre-fabricated component. This is achieved by connecting the oscillation coil support (17) in the air gap (18) to the permanent magnet (15) and/or to magnetic return path device using an elastic membrane (23).

8 Claims, 2 Drawing Sheets

DRIVER FOR A FLAT ACOUSTIC PANEL

FIELD OF THE INVENTION

The invention relates to the design of drivers for flat acoustic panels, in particular the design of drivers that can be used as pre-fabricated components with a large number of acoustic panels.

BACKGROUND OF THE INVENTION

Conventional acoustic panels are known that operate according to the multi-resonance principle, frequently also referred to as multi-resonance plate loudspeakers. Further details of these devices are disclosed in the applications DE-A-197 57 097 to 197 57 099. To avoid unnecessary repetition, the application documents are incorporated herein by reference.

To produce bending waves in an acoustic panel, the panel is excited by one or several electrodynamic drivers (shakers). Other acoustic panels are known that are driven by piezoelectric bending oscillation disks, either exclusively or in combination with the aforedescribed electro-dynamic drivers. The subject matter of the present application, however, applies only the electro-dynamic drivers.

These drivers are formed essentially of an oscillation coil support, at least one permanent magnet and a short-circuit arrangement. The different components are arranged relative to one another so that the oscillation coil projects into an existing air gap. It should also be mentioned that the short-circuit arrangement should be understood as also including devices that merely direct or guide magnetic fields lines. Moreover, in the context of the present application, the air gap should not be understood as only including the gap between components adapted to receive an oscillation coil support and/or the oscillation coil.

The acoustic panel and the electro-dynamic drivers are combined in such a way that the drivers are placed on one side of the acoustic panel or integrated with the panel. If the drivers are placed on one side of the acoustic panel, then driver designs can be used that are also suitable driving cone loudspeakers. More particularly, the unit formed of the short-circuit arrangement and the respective permanent magnets is connected to the acoustic panel with support elements. In this embodiment, the oscillating coil which operates on the acoustic panel and is hence connected with the acoustic panel, can be centered by using centering membranes commonly found in cone loudspeakers. The centering membrane that is connected with the oscillating coil support is herein attached to the support elements. Although these units can be produced inexpensively and in large quantities making use of conventional manufacturing techniques for cone loudspeakers, it is disadvantageous to use these drivers with flat acoustic panels. The attached driver not only increases the depth of the unit, but the support members required with this driver design also increase the stiffness of the acoustic panel, which in turn hinders the generation and propagation of bending waves in the acoustic panel.

For these reasons, other recent designs have attempted to eliminate the support elements and integrate the drivers in the acoustic panel. Such devices are described in DE-A-197 57 097. An important aspect of these devices is that the oscillating coil support and/or the oscillating coil are not connected with the other components of the drivers (short-circuit arrangement, permanent magnet). This makes the design of such devices extraordinarily complex in order to prevent the oscillating coil support and/or the oscillating coil from coming in friction contact with the other components of the driver during operation. This problem may be solved by using a centering membrane known from cone loudspeaker technology and placed between the oscillating coil support and the acoustic panel, as depicted in FIG. 1 of DE-A-197 57 097. However, this solution still leaves another problem, namely to provide a snug association between the remaining components of the drivers (=the element 14.4 in FIG. 1 of DE-A-197 57 097) and the oscillating coil in the acoustic panel, when the drivers are disposed in the acoustic panel.

It is therefore an object of the invention to provide a driver for an acoustic panel, wherein the driver can be pre-produced for a number of different applications and integrated in the acoustic panel without requiring further centering steps.

SUMMARY OF THE INVENTION

By connecting the oscillating coil support in the air gap with the permanent magnet and/or the short-circuit arrangement, a driver is produced that can be integrated in an acoustic panel without requiring additional centering steps.

Since the bottom of the short-circuit arrangement facing away from the permanent magnet is provided with an armature plate and connected through the armature plate with the acoustic panel, assembly of the driver becomes much simpler.

Unlike conventional annular oscillating coil supports, the acoustic panel can be excited over a relatively large-area by forming the oscillating coil support in the shape of a coaxial cylinder, and by connecting to the bottom of the oscillating coil support with the acoustic panel.

The latter is true in particular when the bottom itself, or a plate disposed between the bottom and the acoustic panel, has a diameter that is smaller than or equal to the diameter of the oscillating coil support.

Advantageously, the bottom itself or the plate can be formed as a piezoelectric bending wave oscillator, since the close spacing between two drivers the contact facilitates contact between the drivers. To prevent the driver and the piezoelectric bending wave oscillator from interfering with each other, the piezoelectric bending wave oscillator should be connected with the oscillating coil support of the driver in a decoupled fashion.

If the edge of the oscillating coil support has a region with a decreased wall thickness and if the oscillating coil is connected with the oscillating coil support in this region, then large forces can be transmitted due to the solid design of the machines which are designed for winding oscillating coils on thin wall oscillating coil supports. The transition from the region of decreased wall thickness to the remaining edge of the oscillating coil support can have the form of a step that provides an additional interlocked engagement of the oscillating coil, which decreases the risk that the oscillating coil becomes detached from the oscillating coil support even if large forces are transmitted.

It should be pointed out that an oscillating coil support designed in a manner described above can be used by itself.

BRIEF DESCRIPTION OF THE DRAWINGS

It is shown in.

DETAILED DESCRIPTION OF CERTAIN ILLUSTRATED EMBODIMENTS

The invention will now be described in detail with reference to the drawings.

Figure 1:
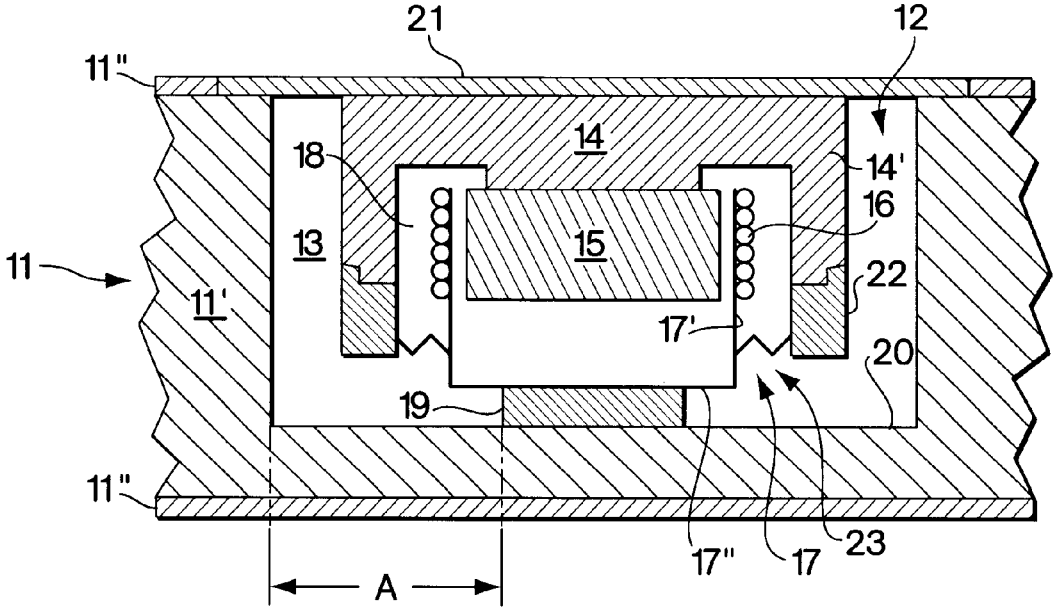
FIG. 1 a cross-sectional view of an acoustic panel.

The arrangement illustrated in FIG. 1 shows an acoustic panel 11 which includes a core layer 11' formed of rigid expanded foam and two cover layers 11" connected with the core layer 11'. FIG. 1 also shows an electromagnetic driver 12 which is inserted in a milled-out portion disposed in the acoustic panel 11.

The driver 13 is formed essentially of a short-circuit arrangement 14 in the form of a coaxial cylinder, a permanent magnet 15 and an oscillating coil support 17 provided with an oscillating coil 16. The permanent magnet is inserted in the short-circuit arrangement formed as a coaxial cylinder and connected thereto. Since the diameter of the permanent magnet 15 is smaller than the diameter of the short-circuit arrangement 14 formed as the coaxial cylinder, a radial gap exists between these two elements (14, 15) which in the context of the present application is referred to as an air gap 18.

The oscillating coil support 17 is also formed as a coaxial cylinder. The edge 17' of the oscillating coil support 17 that holds the oscillating coil 16 is inserted into the air gap 18. The bottom 17" of the oscillating coil support 17 is connected with the bottom 20 of the milled-out portion 13, with a plate 19 disposed therebetween. It should be mentioned that a separate plate 19 is not required if the shape of the bottom 17" of the oscillating coil support 17 and/or of the bottom 20 of the milled-out portion 13 is modified accordingly.

FIG. 1 clearly illustrates that the diameter of the plate 19 is smaller than the diameter of the oscillating coil support 17. This reduction in diameter improves the transmission of bending waves into the acoustic panel 11 by, on one hand, concentrating the transmitted force in a small area and, on the other hand, by increasing the radial gap A, which is important for the generation of bending waves, between the region where the force is introduced and the region where the portion of the driver 12 that does not oscillate during operation is connected with the acoustic panel 11.

The bottom of the short-circuit arrangement facing away from the permanent magnet 15 is provided with an armature plate 21 and connected via the armature plate 21 with the acoustic panel 11.

In the embodiment depicted in FIG. 1, the driver 12 can be preassembled for a many different applications. Moreover, time-consuming centering steps in connection with the assembly of the driver 12 and the acoustic panel 11 can be eliminated by providing the edge 14' of the short-circuit arrangement 14 with a ring 22 that extends the edge 14' in the direction of the plate 19. In addition, a centering membrane 23 can be provided which extends into the gap 18 between the ring 22 and the edge 17' of the oscillating coil support 17. If the driver 12 is formed according to FIG. 1, then the driver 12 can be connected with the acoustic panel 11 simply by inserting the preassembled driver 12 that is already provided with armature plate 21, into the milled-out portion 13 of the acoustic panel 11 and connecting the driver 12 thereto. It is not important, if the oscillating coil support 17 is to be connected with the plate 19 in the factory or at a later time, since the plate 19 is intended to reduce only the diameter relative to the oscillating coil support 17. However, if the plate 19—as will be described below with reference to FIG. 4—is formed as a piezoelectric bending wave disk, then the contact formation can advantageously be improved by connecting the plate 19 formed as a bending wave disk with the oscillating coil support 17 already in the factory, i.e., before connecting the plate 19 with the bottom 20.

For sake of completeness, it should be pointed out that the desired radial gaps between the permanent magnet 15 and the oscillating coil support 17 and/or between the oscillating coil 16 and the edge 14' of the short-circuit arrangement 17 can be set by providing openings (not shown) in the centering membrane 23 and/or the bottom 17" of the oscillating coil support 17, with spacers (not shown) being inserted in the openings during assembly of the driver 12 depicted in FIG. 1. The openings in the centering membrane 23 and/or the bottom 17" can be omitted and a pin (not shown) can be used instead for centering, with the pin being guided through the center of the permanent magnet 15 and the short-circuit arrangement 17. Depending on the design, the pin may extend to the core layer 11'.

Figure 2:
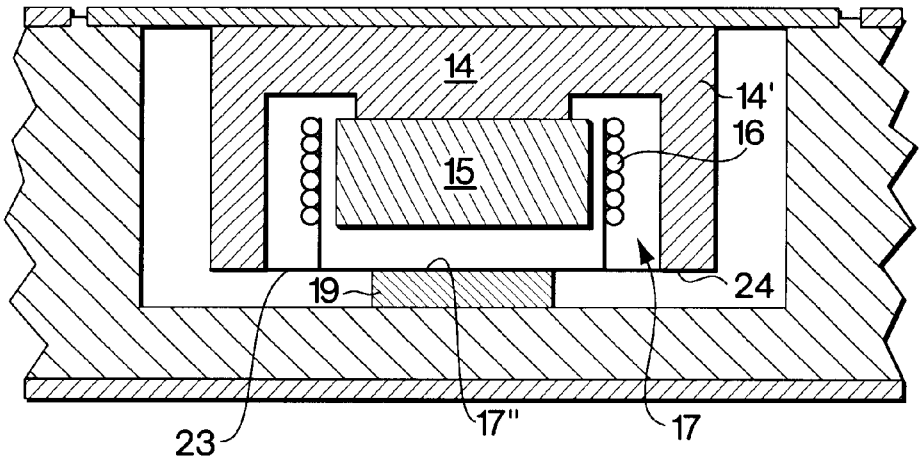
FIG. 2 an additional representation of FIG. 1.

In the embodiment depicted in FIG. 2, the ring 22 of the embodiment depicted in FIG. 1 is replaced by a respective extension of the edge 14' of the short-circuit arrangement 14 and the centering membrane 23 is formed as a flat disk. The centering membrane 23 of FIG. 2 is also connected with the end faces 24 of the edge 14' and the bottom 17" of the oscillating coil support, hence providing additional advantages for manufacture.

In this embodiment, the oscillating coil 16 can be centered with respect to the permanent magnet 15 by providing respective openings (not shown) in the centering membrane 23 and/or the bottom 17" of the oscillating coil support 17.

Figure 3:
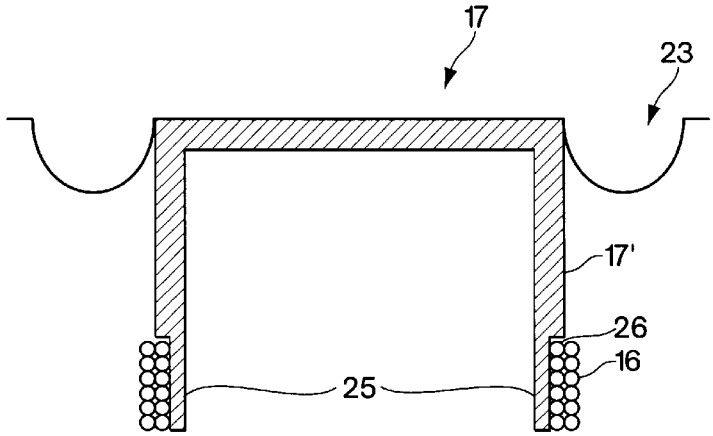
FIG. 3 a cross-sectional view through an oscillating coil support.

FIG. 3 shows in greater detail an oscillating coil support 17 for a that drives an acoustic panel according to FIG. 1 or FIG. 2. As seen clearly in FIG. 3, the edge 17' of the oscillating coil support 17 has a region with a decreased wall thickness, with the oscillating coil 16 being disposed in this region 25. By forming the oscillating coil support 17 with a relatively thick wall, the forces required to drive the acoustic panel 11 can be transmitted to the acoustic panel 11 essentially without deformation losses. The thin-wall section 25 ensures that the resulting air gap 18 (FIG. 1) can be quite small despite the relatively thick wall of the oscillating coil support 17, producing very low losses. In addition, the step 26 disposed between the thin wall region 25 and the remaining oscillating coil support represents an additional support for the oscillating coil 16 on the oscillating coil support 17. FIG. 3 also depicts a curved centering membrane 23 connected with the oscillating coil support 17.

Figure 4:
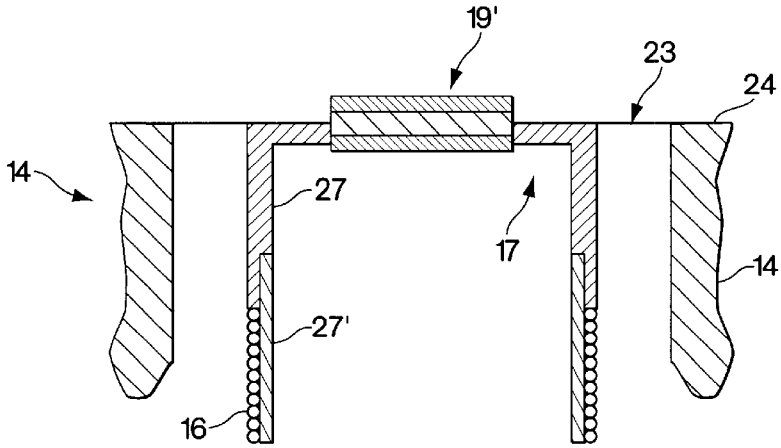
FIG. 4 an additional representation of FIG. 3.

Unlike the oscillating coil support 17 of FIG. 3, the oscillating coil support 17 of FIG. 4 is formed in two parts, consisting of a relatively thick-walled coaxial cylinder 27 and a thin-walled tube 27'. The tube 27' holds the oscillating coil 16 and is connected with the cylinder 27. With the two-part design of the oscillating coil support 17, the assembly consisting of the oscillating coil 16 and the tube 27' can advantageously be manufactured by using the same machines that are employed in the manufacture of similar units for cone loudspeakers.

As already described with reference to FIG. 2, the oscillating coil support 17 depicted in FIG. 4 is also connected through a flat centering membrane 23 with the end faces 24 of the edge 14' of the short-circuit arrangement 14.

Unlike the plate 19 of FIG. 2, which is used only as a spacer, the plate of FIG. 4 is formed as a piezoelectric bending wave disk 19' inserted in the bottom 17" of the oscillating coil support 17 and connected to the oscillating coil support 17 so as to be decoupled (not shown). The combination of the piezoelectric bending wave disk 19' and the electromagnetic driver 12 advantageously provides optimally designed drivers (12, 19') with a small footprint for different frequency ranges.

Figure 5:
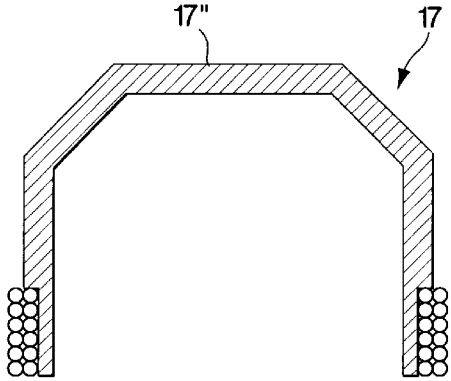
FIG. 5 an additional representation of FIG. 3.

FIG. 5 illustrates another embodiment of an oscillating coil support 17 according to FIG. 3. This one-piece oscillating coil support 17 is constructed so that the diameter of the bottom 17" is smaller than the diameter of the edge 17'. With the oscillating coil support 17 formed as illustrated in FIG. 5, the plate 19 depicted in FIG. 1 is no longer required, since the desired gaps A (FIG. 1) can be readily adjusted by way of selecting the diameter of the bottom 17" of an oscillating coil support 17.

We claim:

1. Driver for a flat acoustic panel comprising an oscillating coil support, an oscillating coil attached to the oscillating coil support, at least one permanent magnet, a short-circuit device connected to the at least one permanent magnet, wherein an air gap is formed between the short-circuit device and the permanent magnet and the oscillating coil support with the oscillating coil projects into the air gap, and an elastic membrane connecting the oscillating coil support with at least one of the permanent magnet and the short-circuit device, wherein a bottom portion of the short-circuit device facing away from the permanent magnet is provided with an armature plate and connected through the armature plate with the acoustic panel.

2. Driver according to claim 1, wherein the oscillating coil support is formed as a coaxial cylinder and includes a bottom portion and an edge portion.

3. Driver according to claim 2, wherein the bottom portion of the oscillating coil support is connected with the acoustic panel.

4. Driver according to claim 3, wherein the bottom portion has a diameter that is smaller than or equal to a diameter of the edge portion of the oscillating coil support.

5. Driver according to claim 2, wherein the bottom is formed as a piezoelectric bending wave disk.

6. Driver according to claim 2, wherein the edge portion of the oscillating coil support includes a region with a reduced wall thickness, and wherein the oscillating coil is connected with the oscillating coil support in the region having the reduced wall thickness.

7. Driver according to claim 3, further including a plate disposed between the bottom portion and the acoustic panel, wherein the plate has a diameter that is smaller than or equal to a diameter of the edge portion of the oscillating coil support.

8. Driver according to claim 7, wherein the plate is formed as a piezoelectric bending wave disk.

* * * * *